US012256848B2

(12) United States Patent
Andersen

(10) Patent No.: US 12,256,848 B2
(45) Date of Patent: Mar. 25, 2025

(54) CHILDS CHAIR OR HIGHCHAIR

(71) Applicant: Jesper Birk Andersen, Kowloon (CN)

(72) Inventor: Jesper Birk Andersen, Kowloon (CN)

( * ) Notice: Subject to any disclaimer, the term of this patent is extended or adjusted under 35 U.S.C. 154(b) by 118 days.

(21) Appl. No.: 18/184,136

(22) Filed: Mar. 15, 2023

(65) Prior Publication Data

US 2023/0292931 A1 Sep. 21, 2023

(30) Foreign Application Priority Data

Mar. 16, 2022 (GB) ..... 2203608

(51) Int. Cl.
*A47D 1/00* (2006.01)
*A47D 15/00* (2006.01)

(52) U.S. Cl.
CPC ..... *A47D 1/004* (2013.01); *A47D 1/00* (2013.01); *A47D 1/006* (2013.01); *A47D 15/006* (2013.01)

(58) Field of Classification Search
CPC ..... A47D 1/004; A47D 1/006; A47D 1/00; A47D 15/006
See application file for complete search history.

(56) References Cited

U.S. PATENT DOCUMENTS 3,246,927 A * 4/1966 Klassen ..... A47C 3/04 297/239
3,909,061 A * 9/1975 Johnson ..... A47D 1/002 297/17
D911,051 S 2/2021 Gronlund et al.
11,202,518 B1 12/2021 Lo

FOREIGN PATENT DOCUMENTS

CN 202950348 U 5/2013
WO 2013184007 A1 12/2013

OTHER PUBLICATIONS

Great Britain Search Report of Great Britain Application No. GB2203608.1 dated Aug. 15, 2022, 2 pages.

(Continued)

*Primary Examiner* — Anthony D Barfield
(74) *Attorney, Agent, or Firm* — Lippes Mathias LLP

(57) ABSTRACT

The invention relates to a child's chair or highchair 1 comprising a seat 2 and four legs 3, the seat 2 having open front and a rear back support 24 and extending forwardly therefrom inclined sides 26 which meet a seat base 25, the four legs 3 being removably attached to the seat 2 by means of leg frame 4 attached to an underside of the seat base and which includes four sockets 9 into which an upper end of each leg 3 is located and connected, each leg 3 extending at an inclined angle outwardly downwards and at the opposite, lower end of each leg 3, feet 8 are provided which each have an external surface corresponding to the inclined angle of the leg so that the chair 1 rests stably on a flat floor. The legs 3 are removable by means of a releasable locking mechanism comprising a receiving hole 11 in each socket 9 and a corresponding the engaging bolt 101 in the each leg 3, the engaging 101 bolt and a retaining bolt 102 and a spring 108 arranged between being is located in a through hole 111 in a leg top section 112 of each leg 3.

9 Claims, 13 Drawing Sheets

(56) References Cited

OTHER PUBLICATIONS (Amazon), Jan. 27, 2022, "Ziza Highchair and Tray", Amazon.co.uk, Available from: http://www.amazon.co.uk/Ziza-Highchair-Toddlers-Scandinavian-Essential/dp/B09B2PM7S?ref_=ast_sto_dp&th=1, 7 pages.
(Smith), Feb. 22, 2022, "Ziza's highchair and tray is the adaptable seat that grows with your tot", independent.co.uk, [online], Available from: https://www.independent.co.uk/extras/inybest/kids/baby-tech-essentials/ziza-highchair-and-tray-review-b2020525.html, 7 pages.
(Safe and Care Co), Oct. 21, 2021, "Ziza Seat User Manual", Safeandcareco.com, [online], Available via "User Guide" link at: http://safeandcareco.com/product/ziza-seat-creamy/, 9 pages.
(Safe and Care Co), Oct. 21, 2021, "Ziza Seat-Creamy", Safeandcareco.com, [online], Available from: https://web.archive.org/web/20211021103107/https:/safeandcareco.com/product/ziza-seat-creamy/, 1 page.
Great Britain Search Report of Great Britain Application No. GB2214253.3 dated Mar. 8, 2023, 2 pages.
Search Report for Great Britain Application No. GB2214665.8, dated Mar. 23, 2023, 1 page.
"Ziza Seat User Manual"; Accessed from www.safeandcareco.com on Aug. 8, 2023; 52 pages; see p. 4.
Smith, Stacey; "Ziza's highchair and tray is the adaptable seat that grows with your tot"; Accessed from https://www.independent.co.uk/extras/indybest/kids/baby-tech-essentials/ziza-highchair-and-tray-review-b2020525.html; Accessed on Aug. 8, 2023; Written Feb. 22, 2022; 8 pages.

* cited by examiner

CHILDS CHAIR OR HIGHCHAIR

CROSS-REFERENCE TO RELATED APPLICATIONS

This application claims priority under 35 U.S.C. § 119, and the benefit of Great Britain Patent Application No. 2203608.1, filed Mar. 16, 2022 and titled "CHILDS CHAIR OR HIGHCHAIR", the entirety of which application is hereby incorporated by reference as is fully set forth herein.

BACKGROUND OF THE INVENTION

1. Field of the Invention

The present invention relates to a child's chair or highchair, and more particularly, to a child's chair or highchair having a detachable tray and a detachable footrest and that is convertible to a child's booster chair.

2. Description of the Prior Art

Child highchairs provide a safe pace for a small child to sit at the level of a table in the company of others at the table and need to be constructed to a high safety standard, and also be easy to use and have pleasing aesthetic design. Generally, the conventional child highchair includes a footrest, for supporting feet of the child comfortably. As the child grows, the fixed position of footrest of the conventional child highchair does not fit the increasing height of the child. Usually, a fixed footrest is located in a mid-range position, which is too far away when the baby is small and too close when the baby has grown and is optimal for a period there between. Thus, it is an objective of the present invention to provide a child's highchair capable of fitting a growing child. It is sometimes desirable to provide a table that is integral to the child's seat for use during eating or playing and it is an objective of the invention to provide a child's seat with an easily attachable table It is sometimes desirable to have a child's seat at a lower position or which can be secured to a pre-existing chair or stool, making the seat easier to transport or move and it is a further objection of the inventive to provide a child high chair which may be converted to a lower child's seat.

SUMMARY OF THE INVENTION

The present invention provides a child highchair having a detachable footrest for solving above drawbacks.

According to the claimed invention, a child highchair includes a supporting frame, a seat disposed on the supporting frame for holding a child, and a leg-rest mechanism connected to the seat. The leg-rest mechanism includes a downward plate whereon at least one first slot is formed, and a footrest whereon a second slot is formed, the second slot being for engaging with the first slot on the downward plate so that the footrest is detachably fixed on the downward plate.

According to the claimed invention, a plurality of first slots is formed on the downward plate, and the second slot on the footrest is selectively engaged with the corresponding first slot for adjusting a distance between the footrest and the seat.

The child highchair of the present invention has a detachable footrest mechanism. The distance between the footrest and the seat can be adjusted conforming to the child's growing (such as the increasing of the height and the leg's length), so the child can put the feet on the footrest (the pedal) comfortably when sitting on the child highchair of the present invention.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
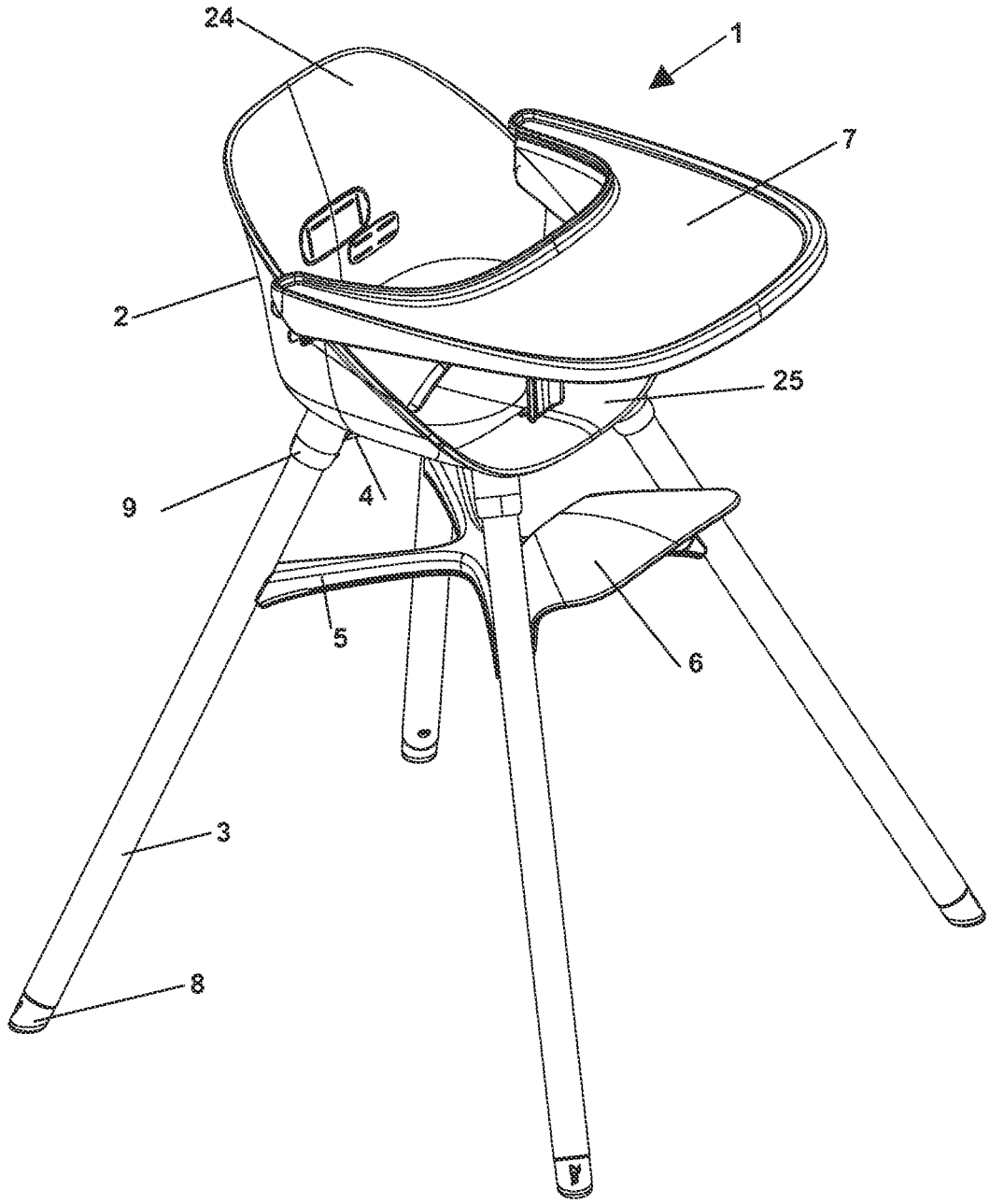
FIG. 1 is a perspective view of a child's chair or highchair according to a first embodiment of the present invention.

In FIG. 1 is shown a perspective view of a child's chair or highchair 1 according to an embodiment of the present invention. The chair 1 comprises a seat 2 and four legs 3. The four legs 3 are removably attached to the seat 2 by means of leg frame 4 which includes four sockets 9 into which an upper end of each leg 3 is located and connected. Each leg extends at an inclined angle outwardly downwards and at the opposite, lower end of each leg 3 feet 8 are provided which each have an external surface corresponding to the inclined angle of the leg so that the chair 1 rest stably on a flat floor. The chair 1 also comprises a support frame 5, a footrest 6 and a removable table 7.

The seat 2 has an open construction possibly made in a single moulded form and having a rear back support 24 and extending forwardly therefrom inclined sides 25 which meet a seat base 26.

Figure 2:
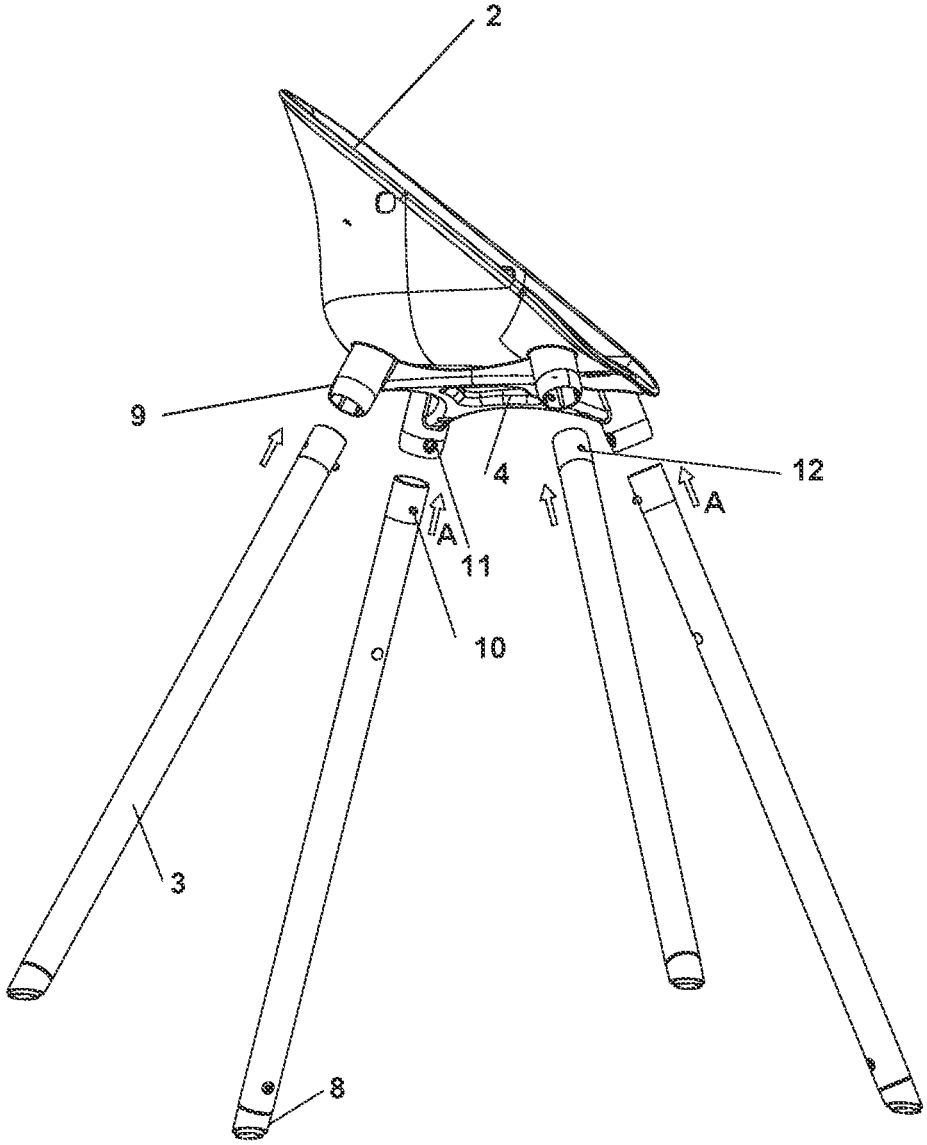
FIG. 2 is an assembly diagram of the child's chair or high chair according to the first embodiment of the present invention showing its removable legs.
Figure 3:
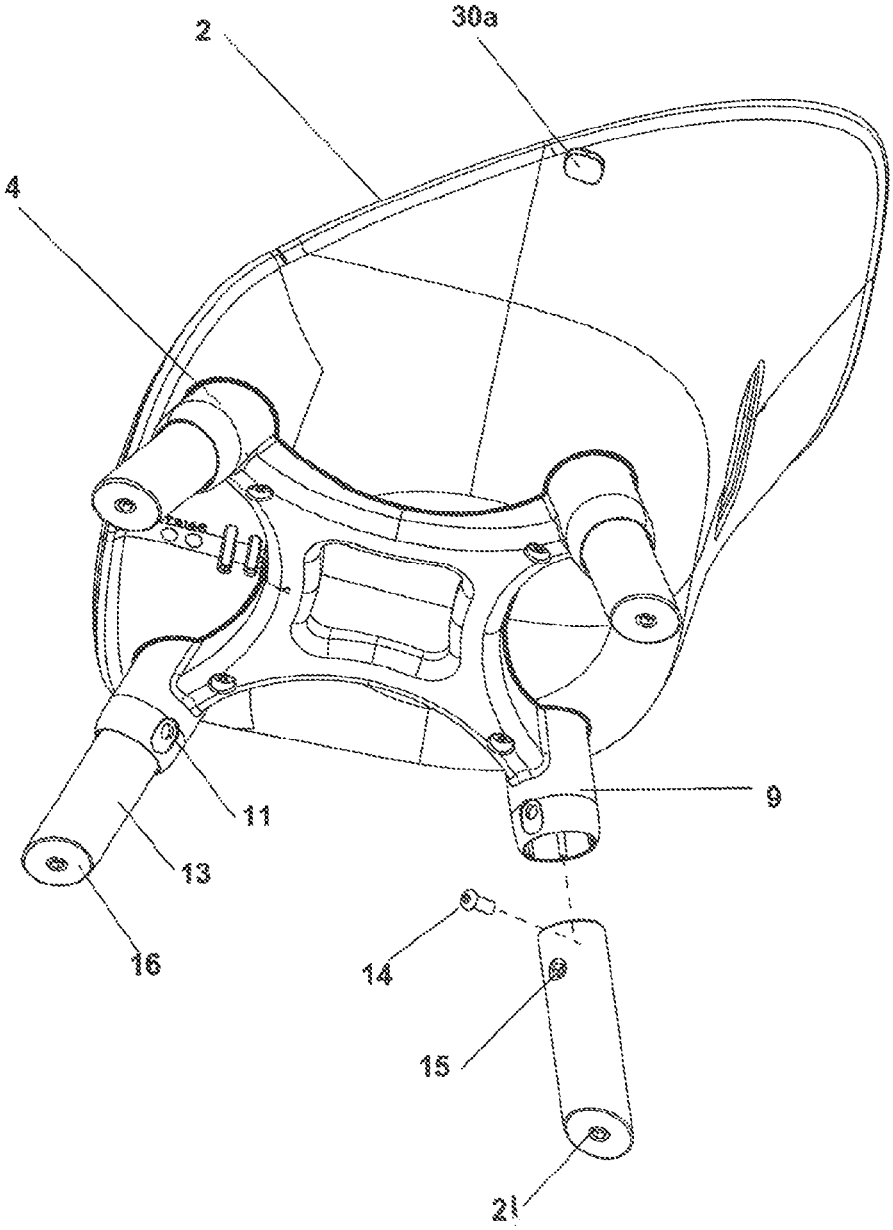
FIG. 3 is an underneath perspective view of the child's chair or high chair with the legs removed.

Referring now to FIG. 2 and FIG. 3 the chair is shown during the early steps of assembly by a user and it can be seen that the legs 3 are insertable into the sockets 9 of the leg frame 4. Once in place the legs are secured in position by suitable screws or bolts 10 which are located in corresponding holes 11, 12 in the socket 9 and leg 3 respectively. In the embodiment shown in FIG. 2 spring loaded bolts 10 are shown in the top part of the legs 3 so that when aligned with the hole 11 in the socket the leg can be pressed home in the socket and the bolt is pressed inwardly against a spring (not shown) and automatically pops out of the hole 11 as soon as the leg 3 is in the correct position in the socket.

FIG. 3 shows a further aspect of the invention in which the legs 3 have been removed and short legs 13 have been fitted into the sockets 9. In this embodiment the short legs are secured in the sockets by means of screws 14 which engage with threaded holes 15 in the short legs 13 when they are located in the fitted position. The short legs 13 also have angled support surfaces 16 at each lower end which together lie in the same flat plane.

Figure 4:
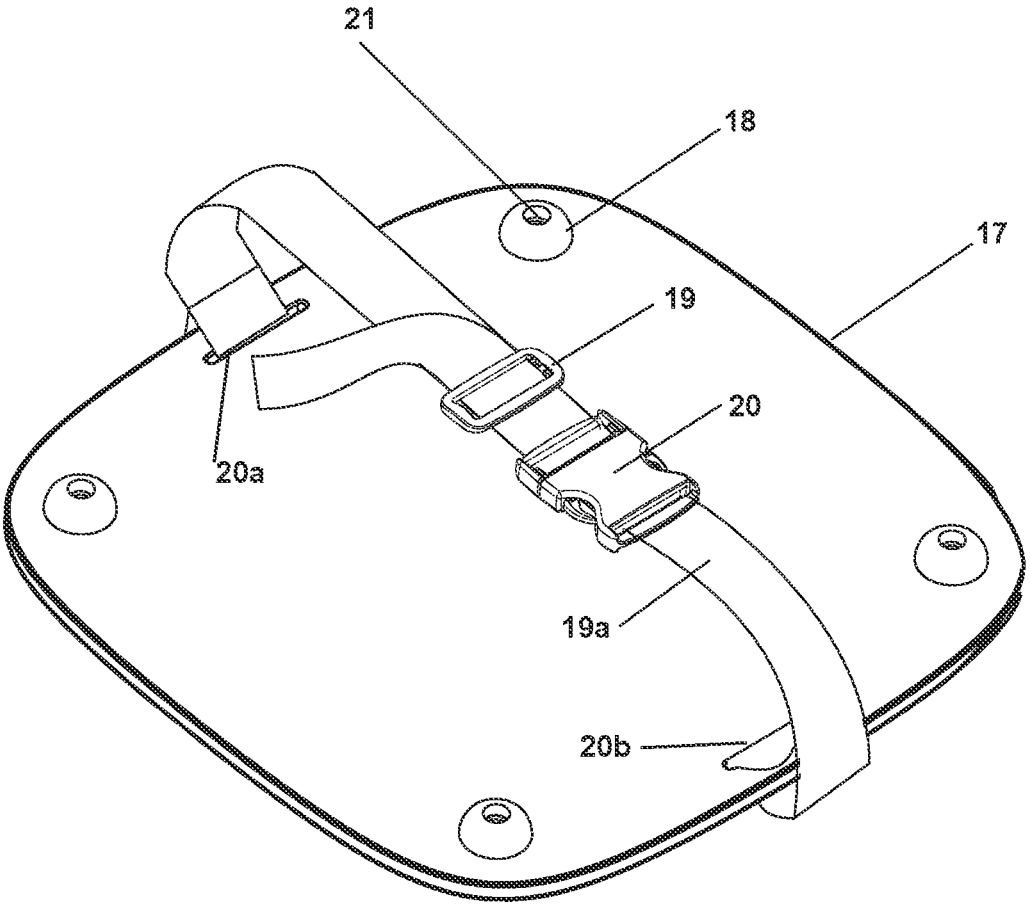
FIG. 4 is a perspective view of a base plate for the child's chair or high chair.
Figure 5:
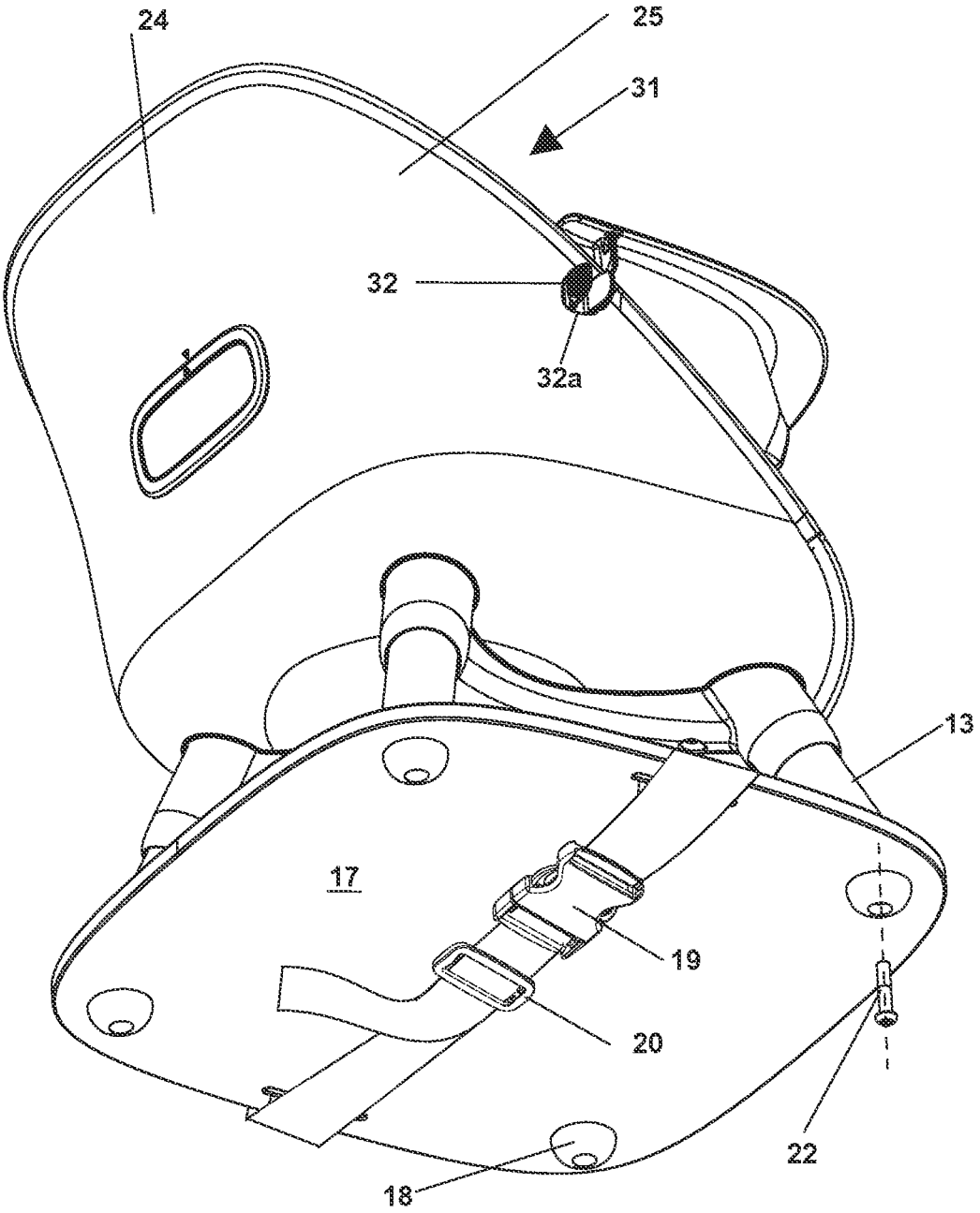
FIG. 5 is an underneath perspective view of the child's chair or highchair with the base plate attached.

Referring now to FIG. 4 a base plate 17 is shown which comprises four base feet 18, one in each corner each having a through hole which is aligned with corresponding threaded holes 21 in the base of each short leg 13. The base plate 17 is secured to the short legs 13 by means of screws 22 being fitted into threaded holes 21 at the base of each short leg 13 forming the complete child's chair 31 as shown in FIG. 5. The feet 18 provide a secure and stable support for the chair 31 and are preferably made from an elastomeric or rubber-like plastic material which does not slide on smooth surfaces. As shown in FIG. 4 the base plate 17 also include a buckle 20 and strap adjuster 19, which together with the strap 19*a* which may be passed through slots 20*a*, 20*b* in the base plate 17 to secure the chair 31 to a pre-existing chair, or stool, so the chair 31 can be used as a booster seat.

Figure 6:
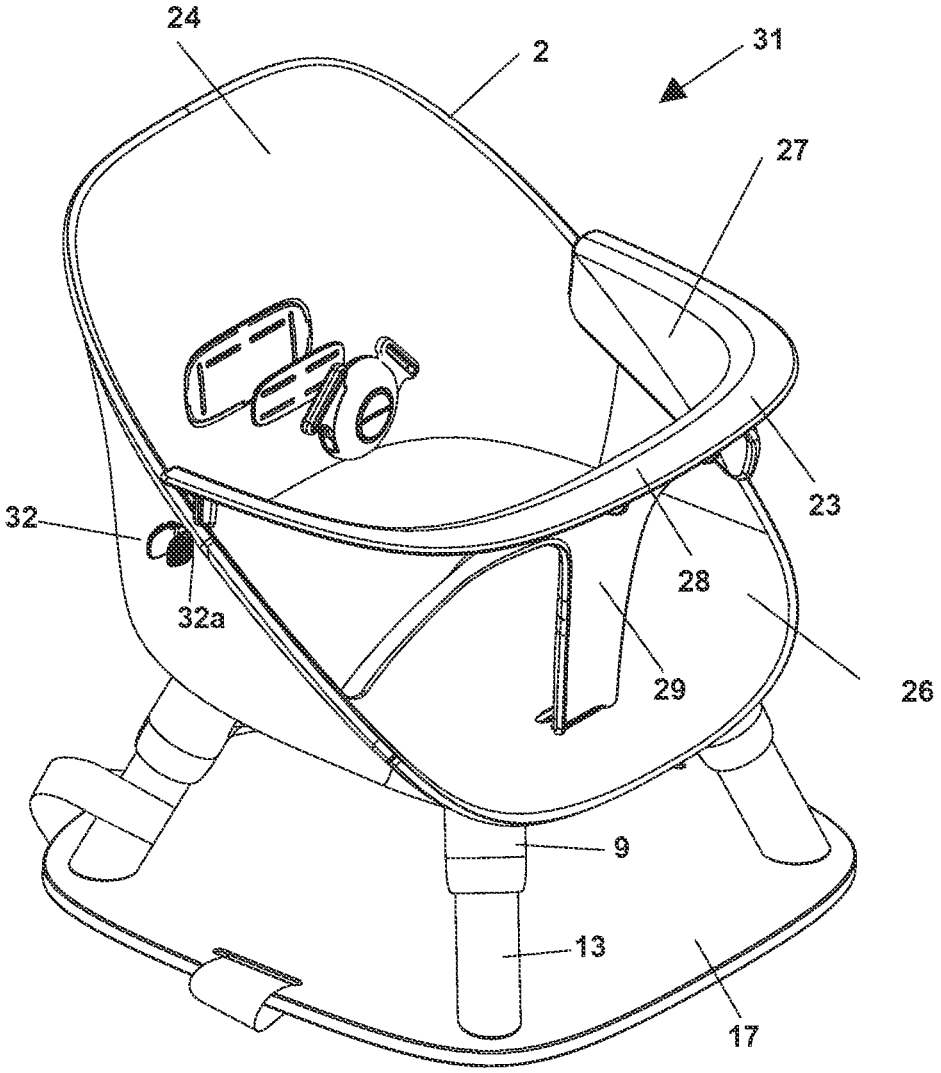
FIG. 6 is a perspective view from above of the child's chair or highchair with the base plate attached.

Referring now to FIG. 6 a perspective view from above is shown of the short-legged child's chair 31. A cross piece 23 is provided which two wing parts 27, a front rail 28 and a central support 29. The cross piece 23 is attached to the seat 2 by each wing part 27 attaching at each seat side 25 and the central support 29 attaching to the seat base 26. The attachment means are by suitably shaped slots 30*a*, 32*a* in the seat side 25 and seat base 26 into which spring biased detent clips 30, 32 are inserted so that when the clips are pressed into the corresponding slots 30*a*, 32*a* the detent parts spring back behind the seat side or base respectively holding the cross piece 23 firmly in place. The cross piece may be removed by a user pinching together the clips 30, 32 and releasing the detent and pushing the clips 30, 32 back through the slots 30*a*, 32*a*, there being sufficient elastic movement in the cross piece for this to occur.

Figure 7:
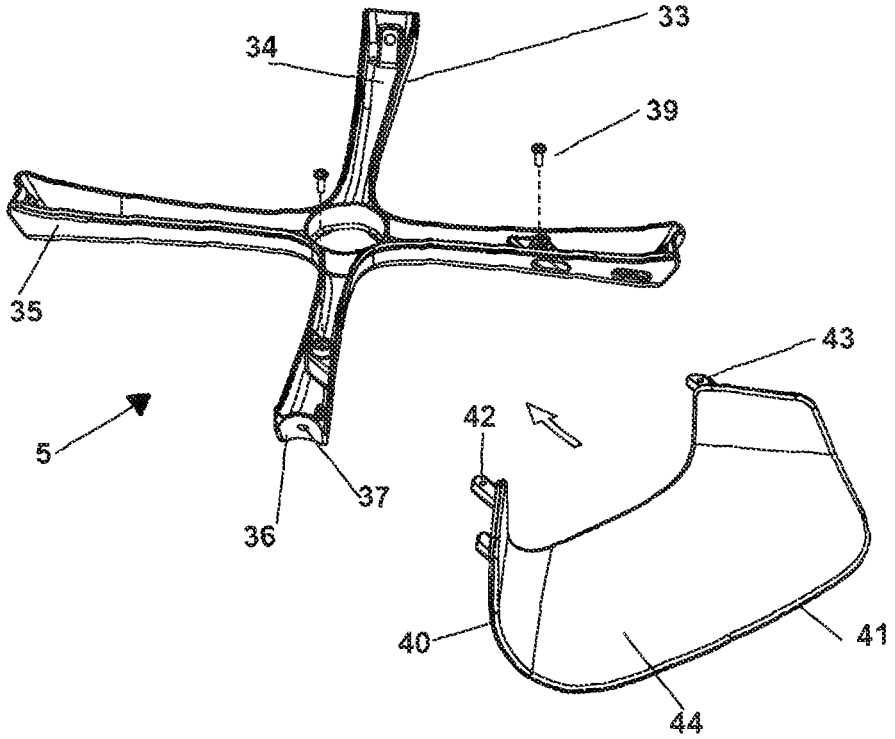
FIG. 7 is a perspective view of the footrest and footrest support frame of the embodiment of the present invention with the footrest being fitted in a first position.
Figure 8:
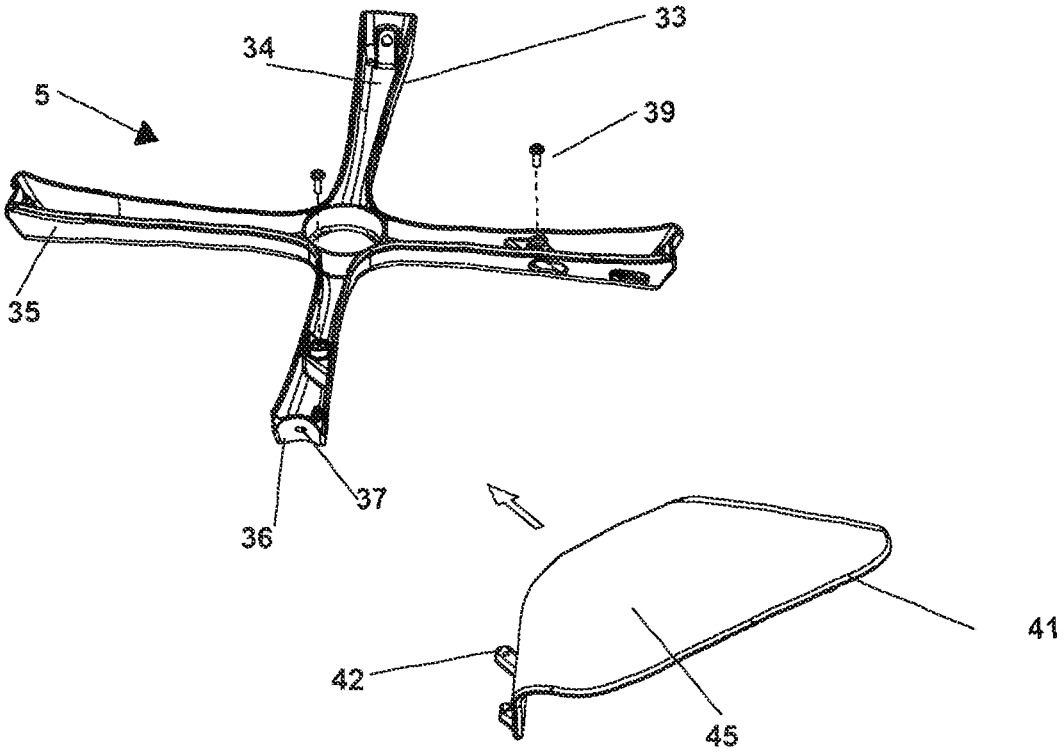
FIG. 8 is a perspective view of the footrest and footrest support frame of the embodiment of the present invention with the footrest being fitted in a second position.

Referring now to FIGS. 7 and 8 the support frame 5 and footrest 6 are shown in more detail. The support frame 5 is shown from the underside and comprises four support arms 33 spaced at 90 degrees from each other and is moulded in a hollow construction with each support arm 33 having a top wall 34 and two side walls 35 and open on the underside. Each support arm 33 also has an end wall 36 comprising a through hole 37 through which securing screws are inserted to secure the support frame 5 to each leg 3. At least two of the support arms 33 also comprise receiving holes 38 for receiving attaching screws 39 for the footrest 6. The footrest 6 is a wide U-shaped form with two side wings 40 joined by a foot rest plate 41 extending between them. Each side wing 40 comprises attaching tabs 42 which include through holes 43 through which attaching screws 39 pass to attach the footrest to the support arms 33 of the support frame 5. The foot rest 6 can be attached to the support frame 5 in two different orientations, a first orientation as shown in FIG. 7 in which an inside surface 44 of the foot rest plate 41 is facing upwards and serves as the rest for the child's feet, and a second orientation as shown in FIG. 8 in which an outside surface 45 of the foot rest plate 41 is facing upwards and serves as the rest for the child's feet.

In this way the distance between the footrest and the seat of the child's chair or highchair can be adjusted according to a height or legs' length of a child, so that the child can put feet on the footrest comfortably when sitting on the child's highchair. The second orientation for a small child and the first orientation for a larger child.

Figure 9:
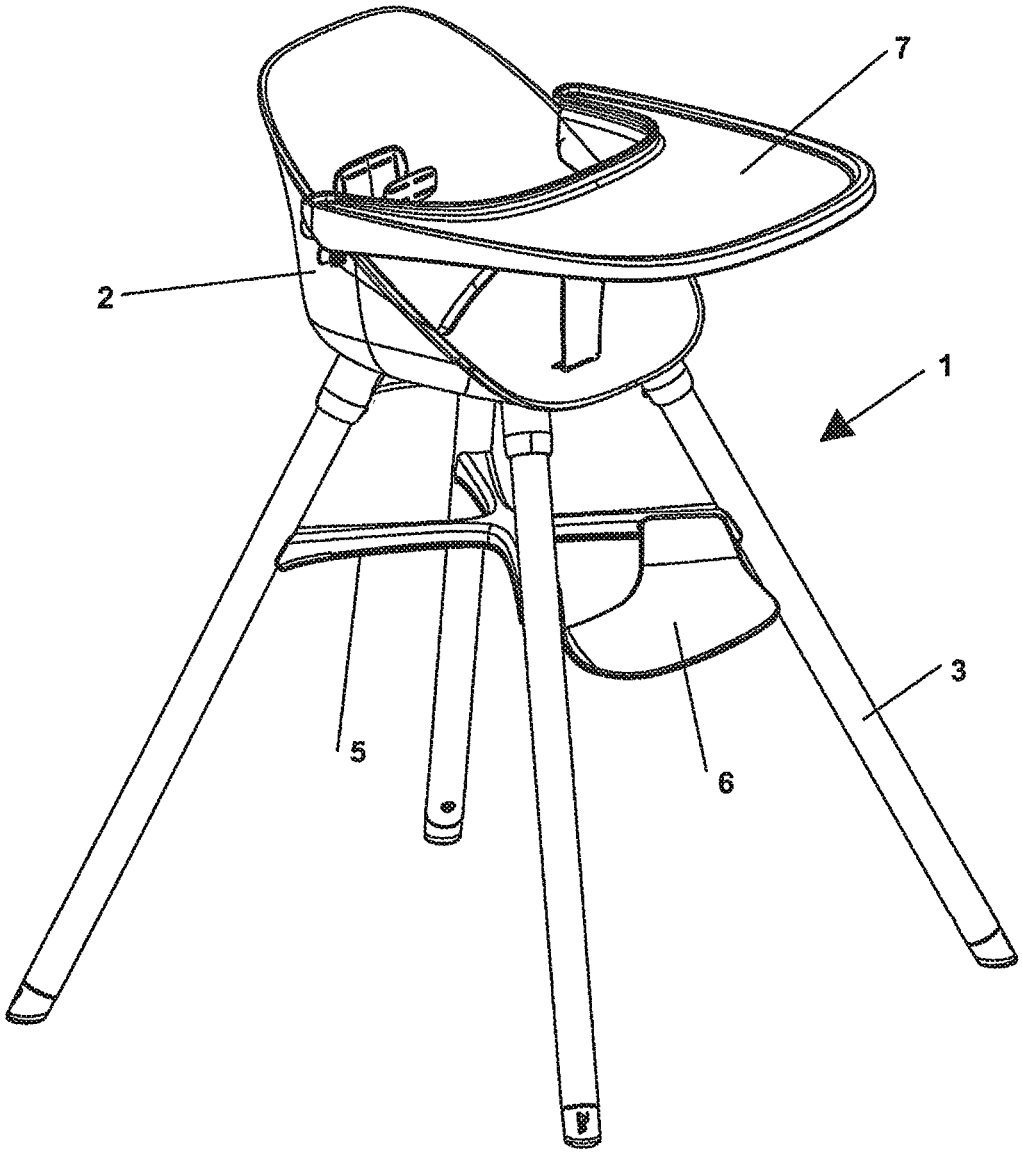
FIG. 9 is a perspective view of the child's chair or highchair with the footrest in the second position.

The child's highchair 1 is shown in FIG. 9 with the footrest 6 fitted in the first orientation with the footrest plate 41 in the lower setting for a larger child.

Figure 10:
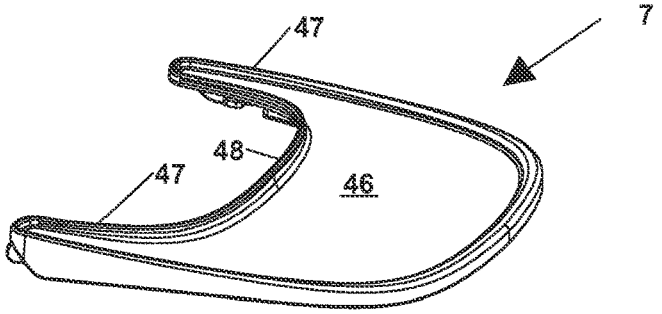
FIG. 10 is a perspective view of a detachable table of a further aspect of the invention.
Figure 11:
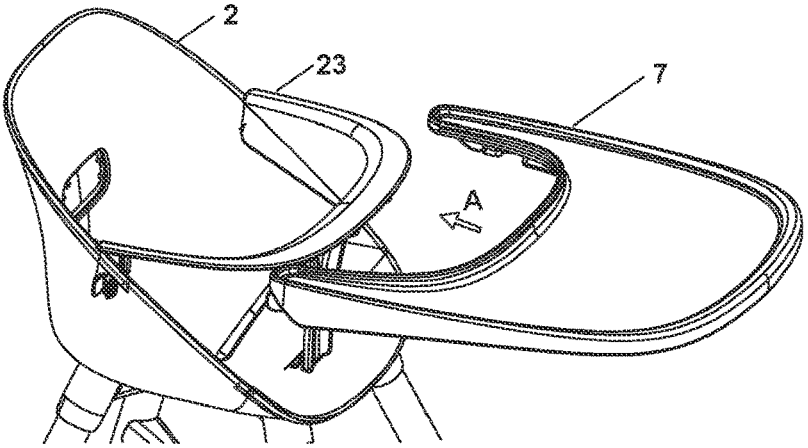
FIG. 11 is a perspective view of the table of FIG. 10 in a first attachment step.
Figure 12:
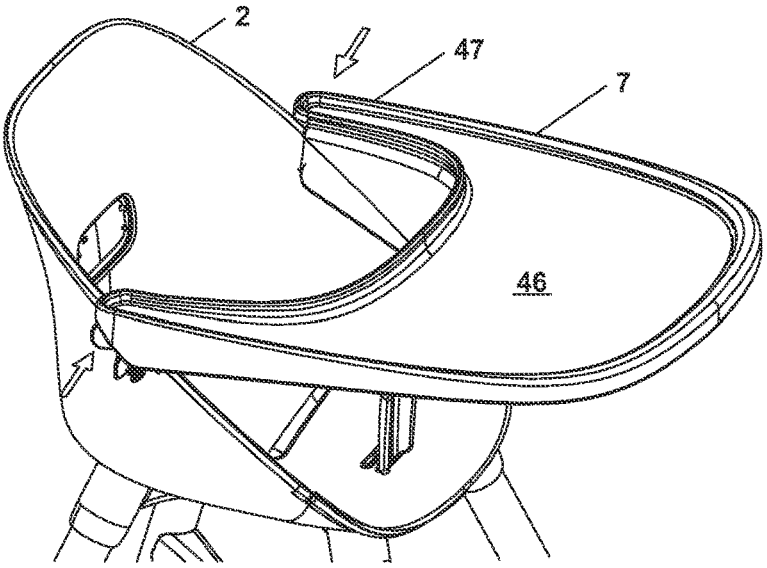
FIG. 12 is a perspective view of the table of FIG. 10 in a second attachment step.

Referring now to FIGS. 10 to 15 details of a further aspect of the invention are described relating to the detachable table 7. FIG. 10 shows the table 7 comprising a flat main table surface 46 and two lateral elongate extensions 47 formed on each side which together with a rear edge 48 of the table form an engaging profile which corresponds with the shape of the cross piece 23. Furthermore, at the end of each elongate extension 47 there are disengageable engagement means 55 which automatically engage with corresponding engagement catches 49 on the cross piece 23 so that when the table 7 is moved towards the cross piece 23 in the direction of arrow A as shown in FIG. 11 the table 7 automatically connects to the cross piece 23 and is securely fixed in the fitted position as shown in FIG. 12.

Figure 13:
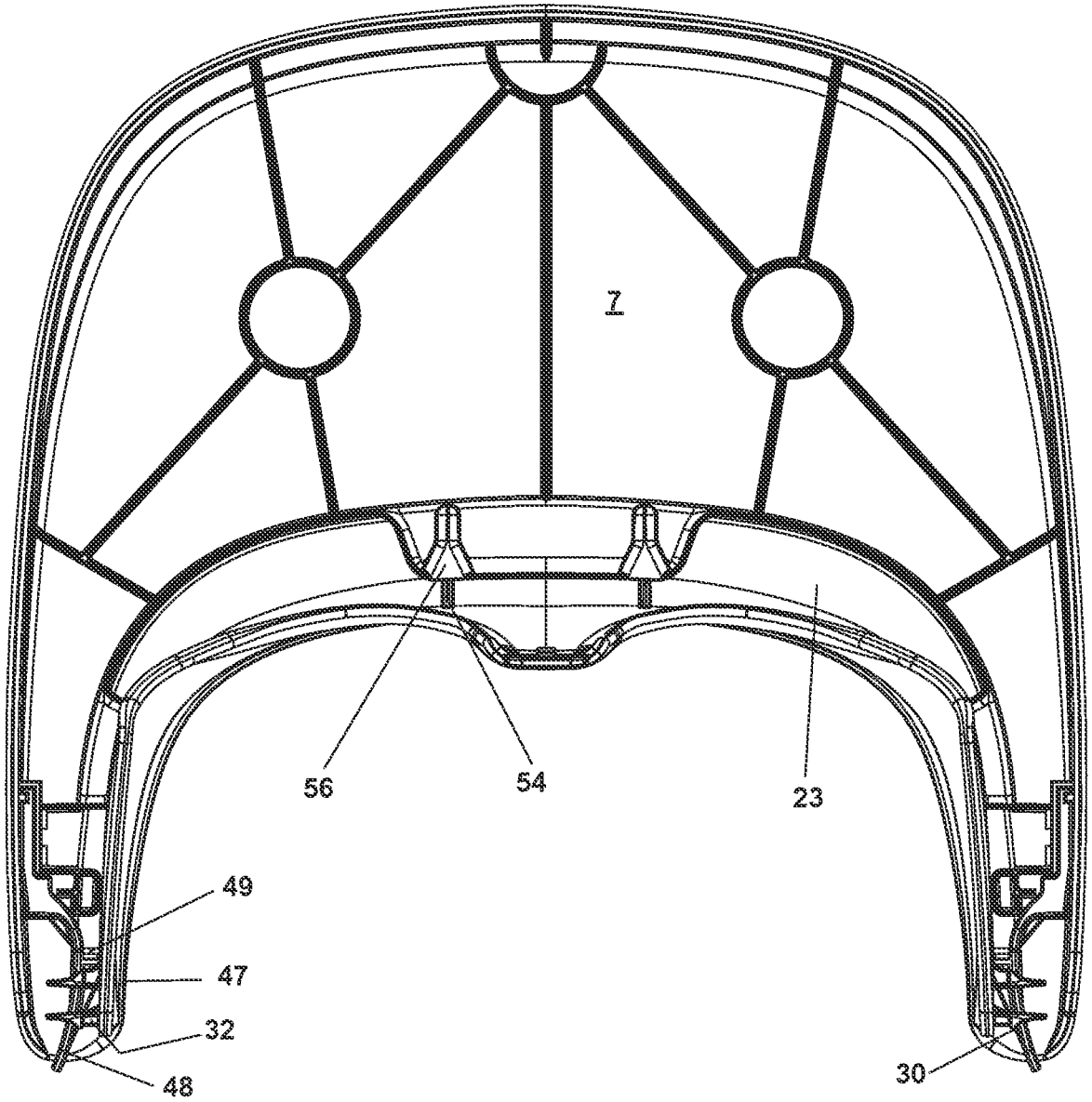
FIG. 13 is an enlarged underside view of the detachable table of FIG. 10 in the attached position.
Figure 14:
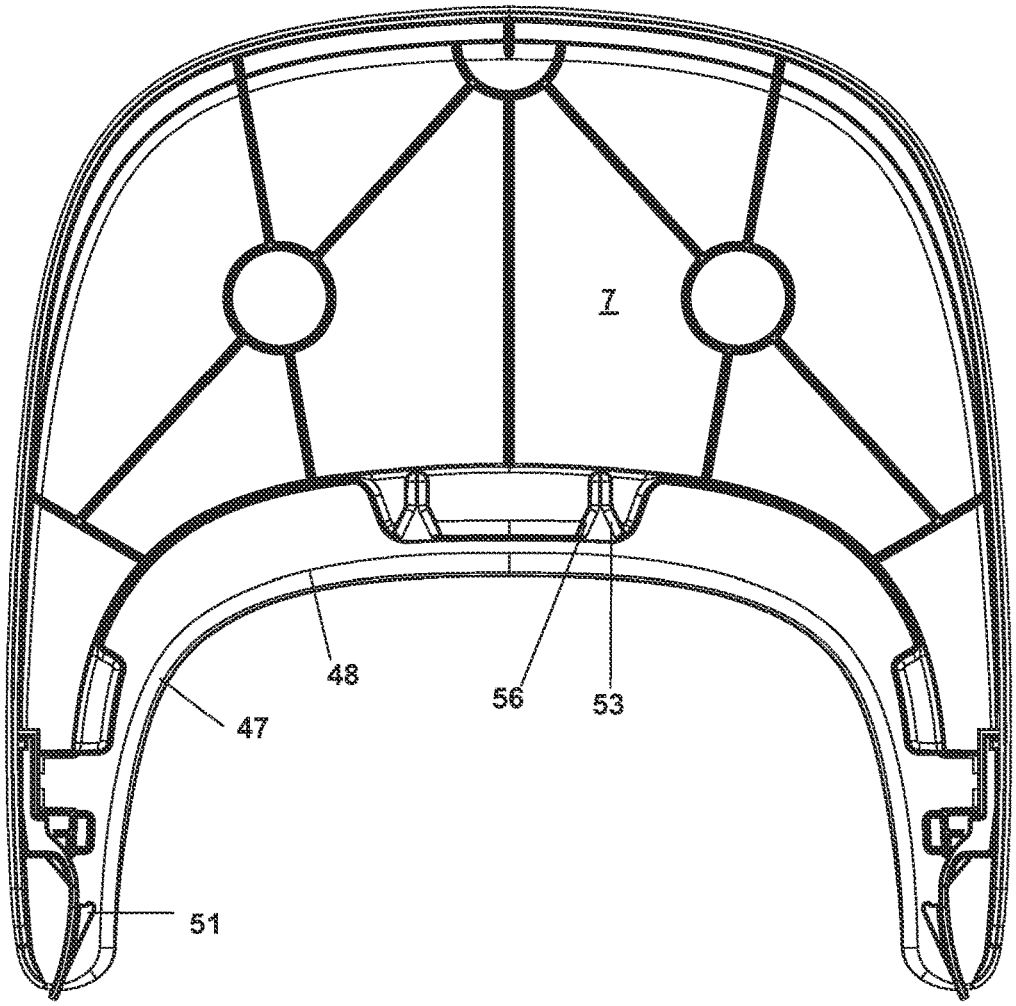
FIG. 14 is an enlarged underside view of the table of FIG. 10 in an unattached position.
Figure 15:
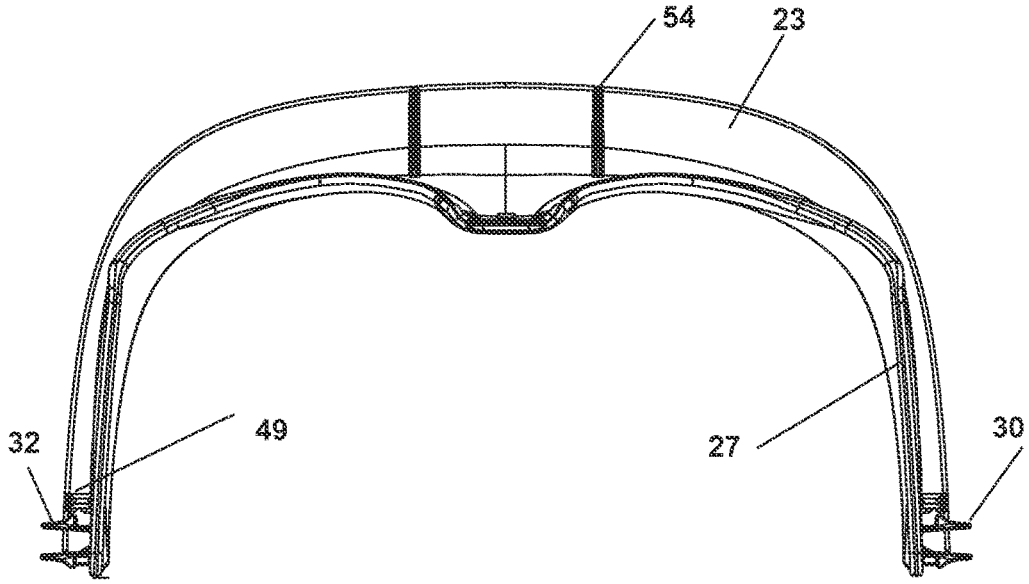
FIG. 15 is an enlarged underside view of a cross support of the child's chair with the table removed.

FIG. 13 shows the underside of the table 7 and cross piece 23 with the table 7 in the fitted position and FIGS. 14 and 15 show the table 7 and crosspiece 23 respectively in the unfitted position. The engagement means 55 is in the form of an elongate resilient leaf spring with a ramped tongue 50 including a ramped surface 51 at the remote end and an oblique surface 52 at the proximal end such that when the user pushes the table 7 to the cross piece 23 the engagement means 55 passes over the engagement catch 49 on the cross piece 23 and the engagement catch 49 rides along the ramped surface 51 pushing the engagement means 55 outwards until the end of the ramp 51 is reached and the ramped tongue 50 of the engagement means 55 snaps into place with the oblique surface 50 abutting the engagement catch 49.

Mutual locating means are provided 53, 54 in the central portion of the rear edge 48 of the table 7 and the cross piece respectively which serve to accurately locate the table 7 in position with respect to the cross piece 23 as the user is fitting the table 7 to the cross piece 23, so that each elongate extension 47 of the table 7 is correctly aligned with the wing parts 27 of the cross piece 23 and the engagement means 55 and engagement catches 49 are correctly aligned so they snap into place automatically.

The locating means 53 on the rear edge 48 includes a V shaped guide 56 which serves to guide the plate shaped locating means 54 of the cross piece 23 which enables the automatic attachment of the table 7, even when the user inaccurately locates the table to the cross piece 23.

Figure 16:
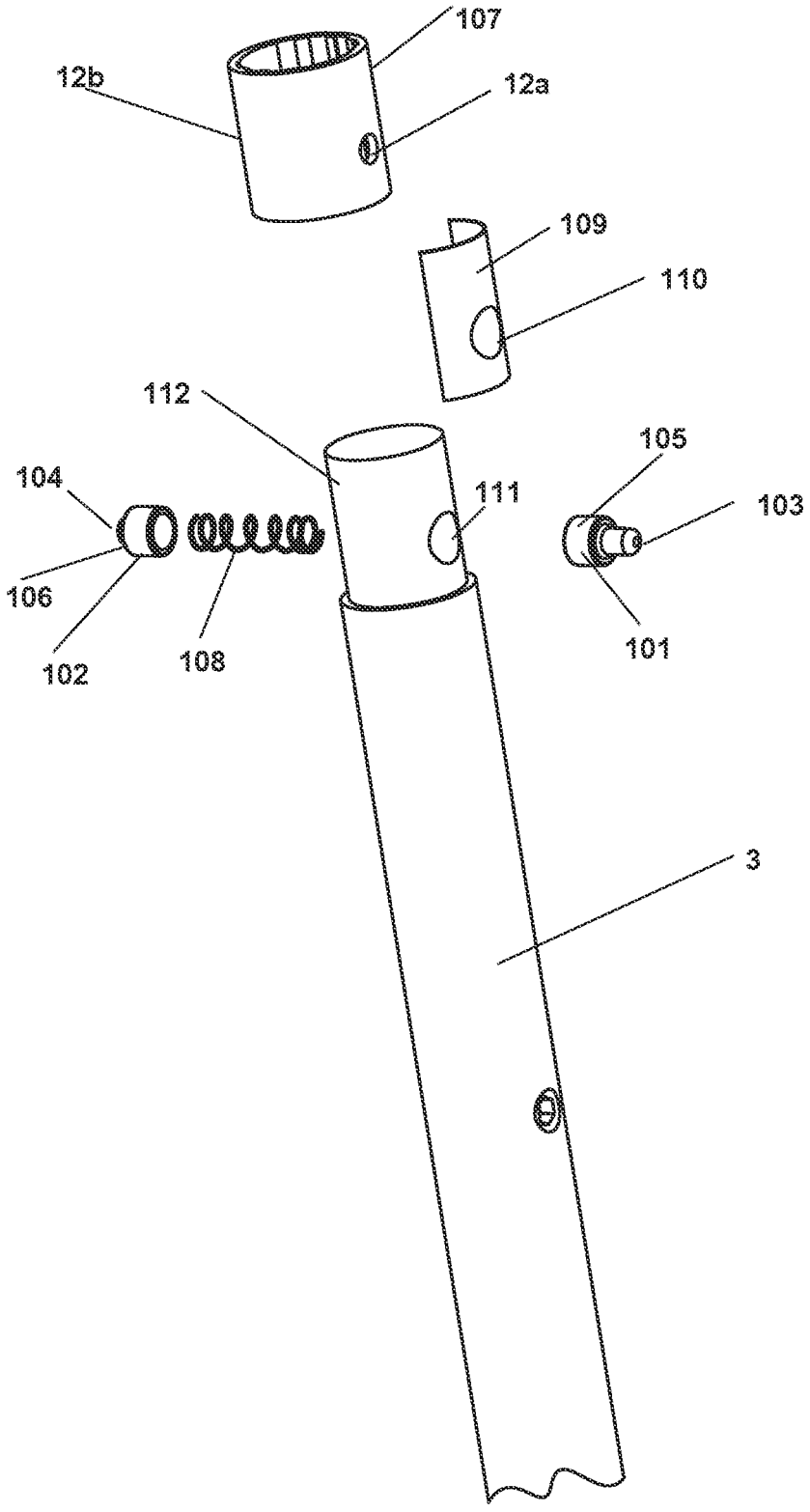
FIG. 16 is a perspective view of a highchair leg the embodiment of the present invention with the component parts separated out.
Figure 17:
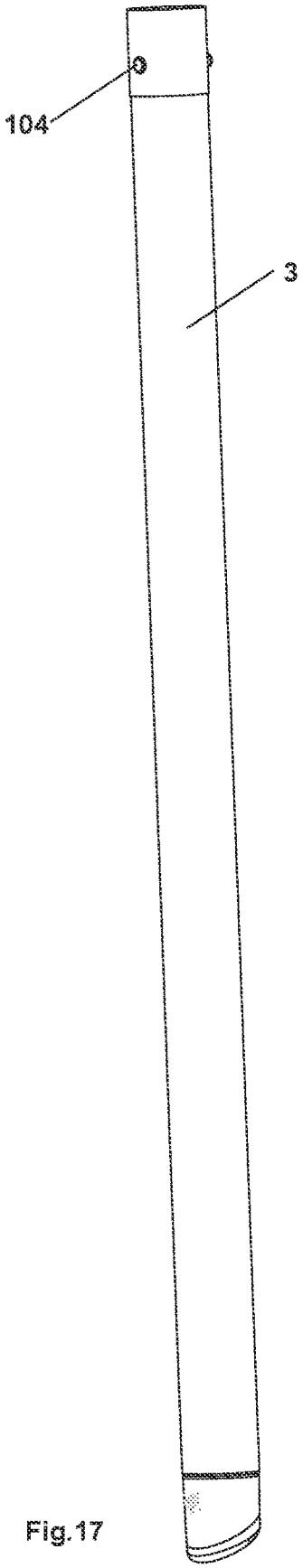
FIG. 17 is a perspective view of the highchair leg of the embodiment of the present invention.
Figure 18:
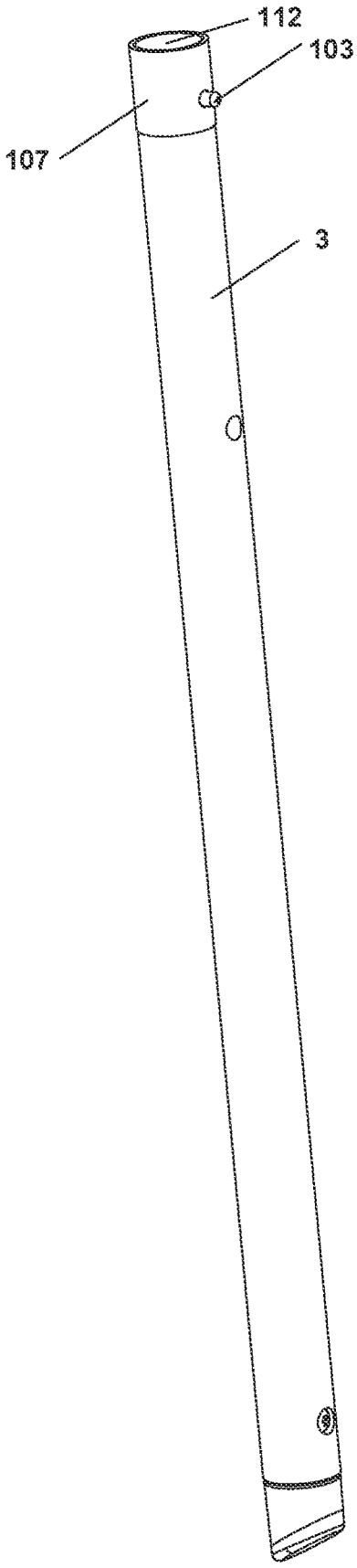
FIG. 18 is a perspective view of the highchair leg of FIG. 17 viewed from the opposite side.

Referring now to FIGS. 16, 17 and 18 one of the highchair legs 3 is shown in further detail and in particular the spring lock mechanism.

Reference is made in particular to FIG. 16 in which the high chair leg 3 is shown which is made from wood in this embodiment and comprises on leg top section 112 which is of reduced diameter compared to the main portion of the leg 3 and is achieved typically by turning honour lays in a known manner. Although leg 3 is made from wood in this embodiment, it could be made of a plastics material and in particular a recycled plastics material or other material that can be formed in this cylindrical elongate shape with a reduced diameter leg top section 112. The leg top section 112 of the leg 3 also includes a through hole 111 which passes entirely through the upper end portion from one side to the other. The locking mechanism includes the engaging bolt 101 a retaining bolt 102 and a spring 108 arranged between them is located in the through hole 111. A sleeve 107 is also provided and is a hollow cylindrical section typically made from a suitable metal such as stainless steel, aluminium or Chrome plated steel is provided which has an internal diameter sufficiently large to slide over the leg top section 112 and an outside diameter which corresponds approximately to the outside diameter of the main portion of the leg 3. The sleeve 107 includes diametrically arranged holes 12*a*, 12*b*, which are positioned such that when the sleeve is fitted on the leg top section 112 the holes 12*a*, 12*b* are aligned with the through hole 111. The engaging bolt 101 includes an engaging peg 103 formed on an engaging bolt base 105 of larger diameter, and the retaining bolt 102 includes a retaining peg 104 formed on a retaining bolt base 106 of larger diameter. The corresponding diameters of the engaging peg 103 and retaining peg 104 as well as the retaining bolt base 106 and the engaging bolt base 105 being such that the engaging peg 103 and the retaining peg 104 can pass through the through hole 111 and the sleeve holes 12*a*, 12*b* whereas the retaining bolt base 106 and the engaging bolt base 105 cannot. This when the locking mechanism is fitted in position with the sleeve 107 arranged over the leg top section 112, the retaining peg 104 extends through the sleeve hole 12*b* on one side and the engaging peg 103 what are three extends through the sleeve hole 12*a* on the opposite side. The retaining peg 104 is somewhat shorter than the engaging peg 103 and is sufficient in length to correspond to the thickness of the sleeve 107 such that the retaining peg 104 does not extend outwardly from the sleeve 107 but merely occupies the sleeve hole 12*b* and prevents accidental, or deliberate removal by a child, of the sleeve 107 in the event that the engaging peg 103 is pressed in too far. The engaging peg 103, being significantly longer than the retaining peg 104, extends through the sleeve hole 12*a* and protrudes further beyond the external surface of the sleeve 107 so that it may engage the socket hole 11 of the socket 9 to securely fix the leg 3 to the base of the chair 2.

In this embodiment shown in FIG. 16 there is furthermore optionally provided a shim 109 which is arcuately shaped to correspond to the diameter of the leg top section 112 and which extends partially around the circumference of the leg top section 112.

The shim 109 may be made from deformable plastic material comprises a shim hole 110. The shim 109 serves to more firmly fix the sleeve 107 to the leg top section 112 to take account of variations in the tolerances in the diameter of the leg top section 112 and the internal diameter of the sleeve 107. Processing wood to consistently very tight tolerances is very difficult to achieve. In order to produce a satisfactory tight interference fit with the sleeve 107 the maximum tolerance for the leg top section is plus or minus nought 0.2 millimetres. Typically the tightest tolerance that is achievable in machining natural wood taking into account changes in temperature and humidity in this stored environment is 0.4 millimetres. Tolerances are generally normally distributed statistically, and this typically results in 20% of legs being out of specification. By means of the use of one or two shims each having a thickness of 0.1 millimetres, selectively utilising the shims for those legs having the smaller diameter top leg section, it is possible to include all of the supplied legs within the specification and none need be rejected or wasted.

Thus during assembly, the shim 109 is fitted around the leg top section 112 with the shim 109 aligned with the through hole 111 and the sleeve 107 is slid over the shim 109 and leg top section 112 to produce a tight interference fit. This tight interference fit is required to securely attach the sleeve 107 to the leg top section 112. During normal manufacture of the legs 3 and sleeve 107 the internal diameter of the sleeve 107, but in particular the external diameter of the top leg section 112 of the leg 3, which is made from a natural wood material and therefore tends to exhibit unpredictable levels of shrinkage or expansion during the manufacturing or storage process, are subject to variations diametrical dimension. This is accommodated by the shim 109 to ensure that the desired interference fit is always achieved.

Those skilled in the art will readily observe that numerous modifications and alterations of the device and method may be made while retaining the teachings of the invention.

COMPONENT LIST

Child's chair or highchair
Seat
Legs
Leg frame
Support frame
Footrest
Removable table
Foot
Socket
Screws or bolts
Socket hole
12*a*, 12*b* Sleeve holes
Short leg
Screw
Threaded hole
Inclined surface
Base plate
Base feet
Strap adjuster 19*a* Strap
Buckle, 20*a* Slot, 20*b* Slot
Threaded hole
Screws
Cross piece
Rear back support
Inclined sides
Seat base
Wing part
Front rail
Central support
Detent clip, 30*a* slot
Short legged child's chair
Detent clip, 32*a* slot
Support arms
Top wall
Side wall
End wall
Through hole
Receiving holes
Attaching screws Side wings
Foot rest plate
Attaching tabs
Through holes
Inside surface
Outside surface
Table surface
Elongate extension
Rear edge
Engagement catches
Ramped tongue
Ramped surface
Oblique surface
Locating means
Locating means
Engagement means
V-shaped guide
101. Engaging bolt
102. Retaining bolt
103. Engaging peg
104. Retaining peg
105. Engaging bolt base
106. Retaining bolt base
107. Sleeve
108. Spring
109. Shim
110. Shim hole
111. Through hole
112. Leg top section

The invention claimed is:

1. A child's chair or highchair comprising a seat and four legs, the seat having open front and a rear back support and extending forwardly therefrom inclined sides which meet a seat base, the four legs being removably attached to the seat by means of leg frame attached to an underside of the seat base and which includes four sockets into which an upper end of each leg is located and connected, each leg extending at an inclined angle outwardly downwards and at the opposite, lower end of each leg, feet are provided which each have an external surface corresponding to the inclined angle of the leg so that the chair rests stably on a flat floor, wherein the legs are removable by means of a releasable locking mechanism comprising a receiving hole in each socket and a corresponding engaging bolt in each leg, the engaging bolt and a retaining bolt and a spring arranged therebetween being located in a through hole in a leg top section of each leg;

wherein a sleeve is also provided in the form of a hollow cylindrical section having an internal diameter sufficiently large to slide over the leg top section, said sleeve including diametrically arranged sleeve holes, which are positioned such that when the sleeve is fitted on the leg top section the holes are aligned with the through hole;

wherein the engaging bolt includes an engaging peg formed on an engaging bolt base of larger diameter, and the retaining bolt includes a retaining peg formed on a retaining bolt base of larger diameter; and wherein the corresponding diameters of the engaging peg and retaining peg as well as the retaining bolt base and the engaging bolt base are such that the engaging peg and the retaining peg can pass through the through hole and the sleeve holes, whereas the retaining bolt base and the engaging bolt base cannot.

2. A child's chair or highchair according to claim 1, wherein the sleeve has an outside diameter which corresponds approximately to the outside diameter of the main portion of the leg.

3. A child's chair or highchair according to claim 1, wherein when the locking mechanism is fitted in position with the sleeve arranged over the leg top section, the retaining peg extends into the sleeve hole on one side and the engaging peg passes through the sleeve hole on the opposite side.

4. A child's chair or highchair according to claim 1, wherein the retaining peg is somewhat shorter than the engaging peg and is sufficient in length to correspond to the thickness of the sleeve such that the retaining peg does not extend outwardly from the sleeve but merely occupies the sleeve hole and prevents accidental, or deliberate removal buy a child, of the sleeve in the event that the engaging peg is pressed too far.

5. A child's chair or highchair according to claim 1, wherein the engaging peg is significantly longer than the retaining peg and extends through the sleeve hole and protrudes further beyond the external surface of the sleeve so that it may engage the receiving hole of the socket to securely fix the leg to the base of the chair.

6. A child's chair or highchair according to claim 1, further comprising a shim which is arcuately shaped to correspond approximately to the diameter of the leg top section.

7. A child's chair or highchair according to claim 6, wherein the shim is made from deformable plastic material.

8. A child's chair or highchair according to claim 6, wherein the shim comprises a shim hole, which may be aligned with through hole and the sleeve holes.

9. A method of manufacturing a leg for a child's chair or highchair that comprises a seat and four legs, the seat having open front and a rear back support and extending forwardly therefrom inclined sides which meet a seat base, the four legs being removably attached to the seat by means of leg frame attached to an underside of the seat base and which includes four sockets into which an upper end of each leg is located and connected, each leg extending at an inclined angle outwardly downwards and at the opposite, lower end of each leg, feet are provided which each have an external surface corresponding to the inclined angle of the leg so that the chair rests stably on a flat floor, wherein the legs are removable by means of a releasable locking mechanism comprising a receiving hole in each socket and a corresponding the engaging bolt in the each leg, the engaging bolt and a retaining bolt and a spring arranged therebetween is located in a through hole in a leg top section of each leg;

wherein a sleeve is also provided in the form of a hollow cylindrical section having an internal diameter sufficiently large to slide over the leg top section, said sleeve including diametrically arranged sleeve holes, which are positioned such that when the sleeve is fitted on the leg top section the holes are aligned with the through hole;

wherein the engaging bolt includes an engaging peg formed on an engaging bolt base of larger diameter, and the retaining bolt includes a retaining peg formed on a retaining bolt base of larger diameter; and wherein the corresponding diameters of the engaging peg and retaining peg as well as the retaining bolt base and the engaging bolt base are such that the engaging peg and the retaining peg can pass through the through hole and the sleeve holes, whereas the retaining bolt base and the engaging bolt base cannot, said method comprising the following steps:

A) measuring a diameter of one of the leg top sections,

B) selecting at least one shim and locating said at least one shim on the one of the leg top sections with a shim hole aligned with the through hole, and C) pressing the sleeve onto the one of the leg top sections and over the at least one shim, with the sleeve hole aligned with the through hole and shim hole to produce a tight interference fit to securely attach the sleeve to the top leg section.

* * * * *